US011759924B2

(12) United States Patent
Chu et al.

(10) Patent No.: US 11,759,924 B2
(45) Date of Patent: Sep. 19, 2023

(54) TORQUE CAPACITY EXPANDABLE DEVICE AND METHOD FOR TORQUE MULTIPLIER

(71) Applicant: CHINA PNEUMATIC CORPORATION, Taoyuan (TW)

(72) Inventors: Hsiu-Feng Chu, Taoyuan (TW); Yu-Wei Chu, Taoyuan (TW)

(73) Assignee: CHINA PNEUMATIC CORPORATION, Taoyuan (TW)

( * ) Notice: Subject to any disclaimer, the term of this patent is extended or adjusted under 35 U.S.C. 154(b) by 259 days.

(21) Appl. No.: 17/381,215

(22) Filed: Jul. 21, 2021

(65) Prior Publication Data

US 2023/0027579 A1 Jan. 26, 2023

(51) Int. Cl.
*B25B 17/02* (2006.01)
*B25B 23/00* (2006.01)

(52) U.S. Cl.
CPC ..... *B25B 17/02* (2013.01); *B25B 23/0078* (2013.01)

(58) Field of Classification Search
CPC . B25B 17/02; B25B 23/0078; B25B 23/0007; B25B 21/007; H02K 7/145
See application file for complete search history.

(56) References Cited

U.S. PATENT DOCUMENTS 7,225,707 B2 * 6/2007 Knopp ..... B25B 21/00 81/57.14
7,950,309 B2 * 5/2011 Junkers ..... B25B 13/488 81/55
2016/0375563 A1 * 12/2016 Junkers ..... B25F 5/026 81/467
2020/0114433 A1 * 4/2020 Kagawa ..... B25B 23/0078
2022/0176522 A1 * 6/2022 Park ..... B25F 3/00

* cited by examiner

*Primary Examiner* — David B. Thomas

(57) ABSTRACT

A torque capacity expandable device and method for a torque multiplier are introduced. The device includes a connection sleeve and a torque multiplier. The connection sleeve, fitted to a torque wrench and the torque multiplier and fastened, has a force-applied end corresponding in dimensions to a force-applying end of the torque wrench and has another end corresponding in dimensions to the force-applied end of the torque multiplier. An integral fastening mechanism is integrally fitted to or formed with each of the two ends of the torque multiplier. Its force-applied end fastening mechanism has the same dimensions as the force-applying end fastening mechanism of connection sleeve. Its force-applying end fastening mechanism has the same dimensions as the force-applied end fastening mechanism of a reaction arm disposed at the force-applying end fastening mechanism of torque multiplier.

7 Claims, 21 Drawing Sheets

TORQUE CAPACITY EXPANDABLE DEVICE AND METHOD FOR TORQUE MULTIPLIER

BACKGROUND OF THE INVENTION

1. Field of the Invention

The present disclosure relates to a torque capacity expandable device and method for a torque multiplier, comprising a connection sleeve fitted to a force-applying end fastening mechanism of a torque wrench and a force-applied end fastening mechanism of a customized torque multiplier to form an integral rigid structure, thereby expanding torque capacity of the torque multiplier.

2. Description of the Related Art

A torque multiplier is a torque magnification device made by means of a reduction gearing mechanism. Its torque magnification ratios increase with its reduction ratios. The rotation speed of its force-applying end decreases with its reduction ratios. The force-applying end of a casing of the torque multiplier has a fastening mechanism integrally fitted to or formed with the casing, so as to fit to a reaction arm or any device capable of sustaining a reaction force arising from fastening a bolt.

The torque multiplier (reduction gearing mechanism) attains different torque magnification ratios when driven with a hand-driven torque wrench, pneumatically-driven or electrically-driven motor and is also commonly known as a nut runner or a torque multiplier.

A high-torque bolting process is commonly carried out in the tool manufacturer with a torque multiplier. It involves driving reduction gearing mechanisms of different reduction ratios with a hand-driven torque wrench, pneumatically-driven or electrically-driven motor, so as to achieve torque magnification. The greater the reduction ratio, the greater the output torque, the lower the output rotation speed, and lower the operating efficiency. The tool manufacturer fits tool handles of the same dimensions and specifications to a pneumatically-driven or electrically-driven motor and then couple together torque multipliers of different gear reduction ratios with a view to providing a series of torque multipliers with different torques.

The high-torque bolting process is carried out step by step to fasten a bolt or nut gradually to attain uniform torque, for example, using a torque multiplier of 6,000 NM capacity with a gear reduction ratio of 2,000:1 (that is, the input end rotates at the speed of 6,000 revolutions per minute to reach the force-applying end by undergoing just three revolutions), so as to tighten threaded joints of target torque 5,000 NM, fastening to 1,500 NM in the first stage, and fastening to 5,000 NM in the second stage. To reduce the torque capacity to its first-stage, the air pressure or voltage of the power driven torque tool must be reduced, albeit at the cost of reducing the rotation speed to the detriment of working efficiency. Furthermore, the torque multiplier of 6,000 NM is heavy and thus burdens the workers, because of high reduction ratios of the reduction gearing mechanism and an overly large number, i.e., four or five stages of the reduction gearing mechanisms. In an attempt to overcome the aforesaid drawbacks, the prior art teaches using an additional lightweight torque multiplier with higher rotation speed and lower torque, such as a 2,000 NM torque capacity one for the first-stage bolting process. However, the cost of this torque multiplier is generally high. The user will have a heavy burden if the user necessitates the use of different torque multipliers capable of attaining respective stages of bolting torque.

Refer to FIG. 1A through FIG. 1C. As shown in FIG. 1A, reaction arm 10 and casing 201 of torque multiplier 20 are integrally formed. Referring to FIG. 1B, a one-stage reduction gearing mechanism 215 is disposed in casing 211 of torque multiplier 21. Referring to FIG. 1B, a two-stage reduction gearing mechanism 225 is disposed in casing 221 of torque multiplier 22. Both their force-applied ends 212, 222 correspond in dimensions and type to the force-applying end of the torque wrench. As shown in FIG. 1B and FIG. 1C, casings 211, 221, 231 of torque multipliers 21, 22, 23 are not integrally formed with reaction arm, fastening mechanisms 214, 224, 234 integrally with or fitted to casings 211, 221, 231 are disposed at force-applying ends 213, 223, 233 so as to be fittedly connected to reaction arm 11.

Refer to FIG. 2A, FIG. 2B and FIG. 3. Referring to FIG. 2A and FIG. 2B, a hand-driven torque wrench 40 drives the hand-driven torque multiplier comprising torque multipliers 20, 23 and reaction arms 10, 11 shown in FIG. 1A and FIG. 1C. The force-applying ends 203, 233 drive a socket 30 to tighten the threaded joint 301 with the expanded torque. As shown in FIG. 3, the reaction arm 10 presses against the rigid structure 101 at the periphery of threaded joint 301. The rigid structure 101 has sufficient structural strength to sustain the reaction force arising from the bolting process.

Referring to FIG. 4A and FIG. 4B, a reduction gearing mechanism of at least one stage is disposed in casings 211, 221, 231 of conventional torque multipliers 21, 22, 23 to attain different reduction ratios and torque magnification ratios. Referring to the upper diagram of FIG. 4A, there is shown a cross-sectional schematic view of a one-stage reduction gearing mechanism 215. Referring to the lower diagram of FIG. 4A, there is shown a cross-sectional schematic view of a two-stage reduction gearing mechanism 225. As shown in the diagrams, force-applying ends 213, 223 are fittedly connected to the reaction arm by fastening mechanisms 214, 224. FIG. 4B is a perspective schematic view of torque multiplier 21 shown in FIG. 4A. FIG. 4B is a perspective schematic view of torque multiplier 22 shown in FIG. 4A.

Referring to FIG. 5A through FIG. 5D, a pneumatically-driven torque multiplier (or electrically-driven torque multiplier) having different stages of torque and shown in FIG. 5B, FIG. 5C and FIG. 5D comprises a pneumatically-driven torque wrench 50 coupled to torque multipliers 21, 22, 23 and fitted to reaction arms 11, 11', 11", respectively. Conventionally, the same pneumatically-driven torque wrench 50 (or electrically-driven torque wrench) operates in conjunction with torque multipliers 21, 22, 23 of different reduction ratios and torque magnification ratios and then fits to reaction arms 11, 11', 11", such that the pneumatically-driven torque multiplier (or electrically-driven torque multiplier) attains a range of stages of torque, as shown in FIG. 5B through FIG. 5D. Furthermore, torque multipliers 21, 22, 23 operate in conjunction with reaction arms 11, 11', 11", respectively, whereas torque multiplier 23 is greater than torque multiplier 22, and torque multiplier 22 is greater than torque multiplier 21. As a result, reaction arm 11" has greater dimensions, structural strength and weight than reaction arm 11', whereas reaction arm 11' has greater dimensions, structural strength and weight than reaction arm 11.

Refer to FIG. 6A, FIG. 6B and FIG. 7. A conventional method of torque expansion is illustrated by FIG. 6A and FIG. 6B. Referring to FIG. 6A, a hand-driven torque wrench drives a first torque multiplier, and then a force-applying end of the first torque multiplier drives a second torque multiplier. During the bolting process, both the first reaction arm and second reaction arm sustain the reaction force. Furthermore, FIG. 7 shows that the force-applied end of the hand-driven torque wrench drives a torque multiplier of high multi-stage reduction ratios.

BRIEF SUMMARY OF THE INVENTION

An objective of the present disclosure is to provide a torque capacity expandable device for a torque multiplier, comprising a connection sleeve fitted to a force-applying end fastening mechanism of a torque wrench and a force-applied end fastening mechanism of a customized torque multiplier to form an integral rigid structure, thereby expanding torque capacity of the torque multiplier. The torque capacity expandable device of the present disclosure is advantageously cost-efficient and easy to operate, thereby greatly increasing its industrial applicability.

According to the present disclosure, a force-applied end fastening mechanism of a connection sleeve is fittedly connected to a force-applying end fastening mechanism of a torque wrench, and it's another end is fittedly connected to a force-applied end fastening mechanism of a customized torque multiplier. The fastening mechanisms prevent two ends fittedly connected from rotating relative to each other. The fastening mechanisms have sufficient structural strength to sustain the load arising from the bolting process. Therefore, the present disclosure uses a low-torque, high-rotation-speed torque wrench and a connection sleeve to resiliently, fittedly connect to a customized torque multiplier of different torque magnification ratios and even fitted to the multilayer, stacked customized torque multiplier according to the required bolting torque magnitude, so as to attain different stages of torque capacity. The present disclosure effectively enhances working efficiency, lessens workers' workload, and greatly reduces tool cost.

In an embodiment, according to the present disclosure, the customized torque multiplier is a torque magnification device comprising a reduction gearing mechanism. The greater the reduction ratio, the greater the torque magnification ratio, the greater the output torque, the slower the tool force-applying end rotates, which is different from commercially available torque multipliers in that two ends of the casings of the customized torque multiplier must be integrally formed with the casings or fitted to the casings to form an integral fastening mechanism.

In an embodiment, the connection sleeve functions as the reaction arm and thus is also known as a reaction ring, and its purpose is to sustain the reaction force arising from a threaded joint during the bolting process. When the connection sleeve is fittedly connected to another customized torque multiplier, it replaces the first reaction arm used by the first customized torque multiplier. Owing to the fastening mechanisms, it is feasible for the connection sleeve and the casing of another customized torque multiplier to be integrally fitted together. The connection sleeve can be coaxial ring-shaped or non-coaxial ring-shaped, provided that the force-applying anvil of the torque wrench smoothly drives the force-applied bushing of the customized torque multiplier and enables the casing of the torque multiplier and the casing of the driven customized torque multiplier to be connected together to thereby form a rigid, integral structure. The fastening mechanism of the connection sleeve is a coaxial dentate bolt structure or any structure whereby the casing of the force-applying end of the torque multiplier and the casing of the customized torque multiplier connected thereto are coupled together to form an integral rigid structure, with its structural strength sufficient to sustain the magnified torque capacity.

In an embodiment, the customized torque multiplier of the present disclosure is different from a conventional torque multiplier and is characterized in that an integral fastening mechanism is disposed at two ends of its casing and integrally fitted to the casing. The force-applied end fastening mechanism of the customized torque multiplier corresponds in dimensions and type to the force-applying end fastening mechanism of the connection sleeve, whereas the force-applying end fastening mechanism corresponds in dimensions and type to the force-applied end fastening mechanism of another connection sleeve, the force-applied end fastening mechanism of the reaction arm, or the force-applied end fastening mechanism of any another device, allowing another connection sleeve, reaction arm or any other device to sustain the reaction force arising from the bolting process.

In an embodiment, according to the present disclosure, the connection sleeve (reaction ring) which sustains the two casings is made of metal or non-metal to thereby integrally connect the force-applying end fastening mechanism of the torque wrench and the force-applied end fastening mechanism of the customized torque multiplier. The force-applying anvil of the torque wrench and the force-applied bushing of the customized torque multiplier are smoothly rotated; thus, the torque wrench is selectively fittedly connected to the customized torque multipliers of different torque magnification ratios according to the torque to be magnified, so as to resiliently expand torque capacity. The connection sleeve of the present disclosure is flexibly designed in accordance with the types of the force-applied end and force-applying end of the casings to prevent them from moving relative to each other.

In an embodiment, the present disclosure is applicable to a translational transmission mechanism capable of achieving torque expansion with parallel axles to drive another customized torque multiplier. In this regard, the force-applying end fastening mechanism of the torque wrench must still be connected to the force-applied end fastening mechanism of the translational transmission mechanism by a component functioning as the connection sleeve, for example, a coaxial ring-shaped mechanism.

In an embodiment, the same connection sleeve is fittedly connected to the customized torque multipliers of different torque magnification ratios. One end of the cover of the force-applied end of each customized torque multiplier corresponds in dimensions and type to the force-applying end fastening mechanism of the connection sleeve. The another end of the cover of the force-applied end corresponds in dimensions and type to the force-applied end fastening mechanism at the casing of the customized torque multiplier.

In an embodiment, the fastening mechanism is disposed at the force-applied end or force-applying end of the customized torque multiplier or the torque wrench and the rigid mechanism of the reaction arm and has sufficient structural strength to sustain two objects fittedly connected and thus prevent them from rotating relative to each other. The fastening mechanism is of any type, such as a dentate bolt of regular or irregular shape.

In an embodiment, the torque expansion of the present disclosure is achieved in accordance with the required magnitude of the bolting torque by fittedly connecting one or more connection sleeves to one or more customized torque multipliers and fittedly connecting a resilient multilayer to the force-applying ends stacked on different types of torque wrenches.

In an embodiment, the reaction arm is fittedly connected to the force-applying end of the customized torque multiplier or the torque wrench to sustain the reaction force arising from the bolting process. The reaction arm is of different types, depending on the shape of the periphery of the threaded joint. The reaction arm is fittedly connected to the force-applying end of the customized torque multiplier or the torque wrench. Alternatively, the reaction arm and the connection sleeve are integrally formed.

Therefore, according to the present disclosure, the torque capacity expandable device for a torque multiplier has advantages described below. The connection sleeve and customized torque multiplier (a fastening mechanism is disposed at each of the two ends of the casing of the customized torque multiplier) enable a user to resiliently, rapidly, economically and efficiently fit and expand a low-torque torque wrench so that it attains a high torque required by the user.

DETAILED DESCRIPTION OF THE INVENTION

To facilitate understanding of the object, characteristics and effects of this present disclosure, embodiments together with the attached drawings for the detailed description of the present disclosure are provided.

Figure 1A:
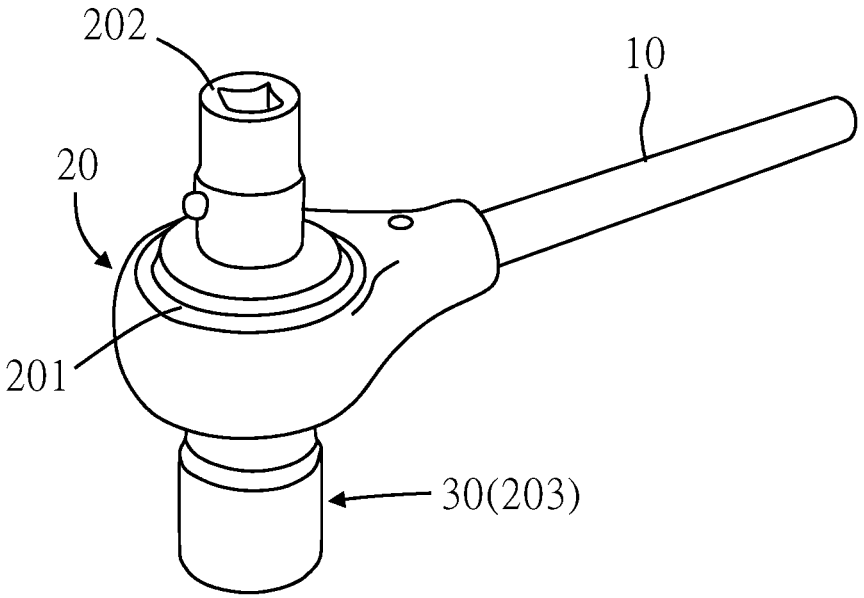
(PRIOR ART) FIG.1A
FIG. 1A (PRIOR ART) is the first schematic view of a torque multiplier.
Figure 1B:
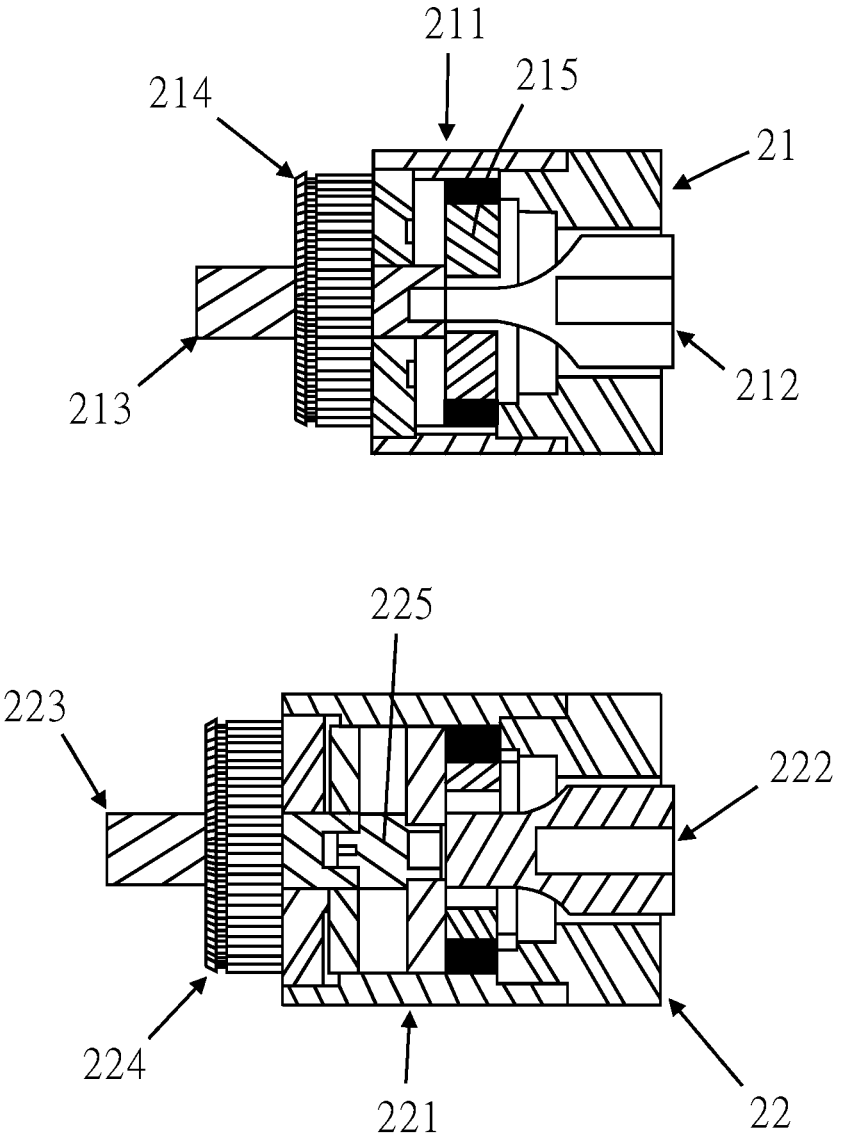
(PRIOR ART) FIG.1B
FIG. 1B (PRIOR ART) is the second schematic view of the torque multiplier.
Figure 1C:
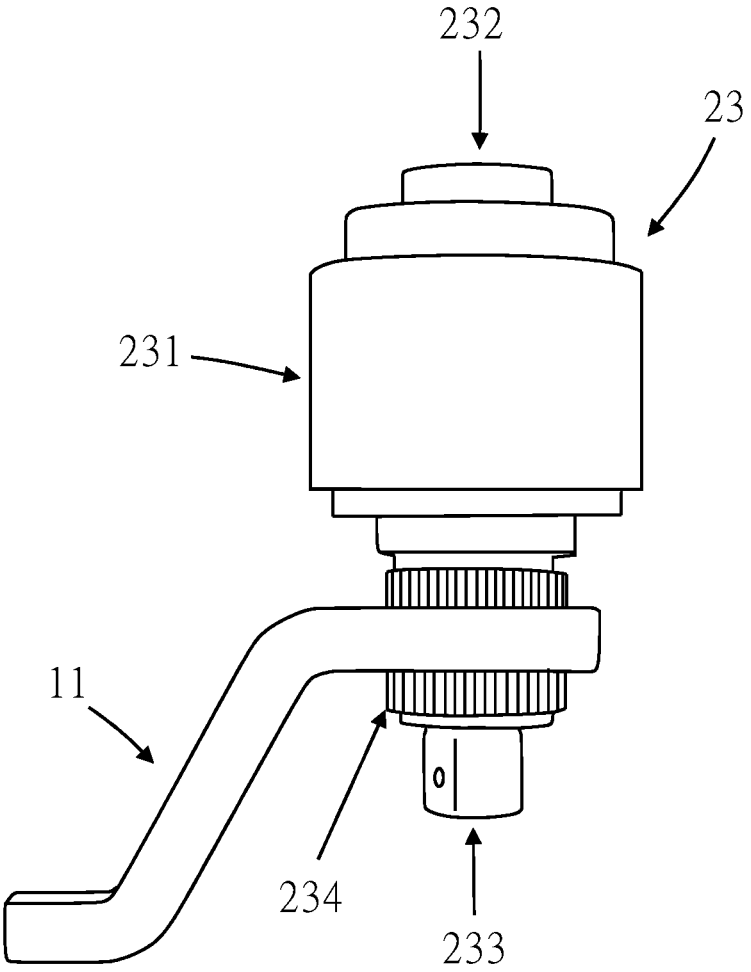
(PRIOR ART) FIG.1C
FIG. 1C (PRIOR ART) is the third schematic view of the torque multiplier.
Figure 2A:
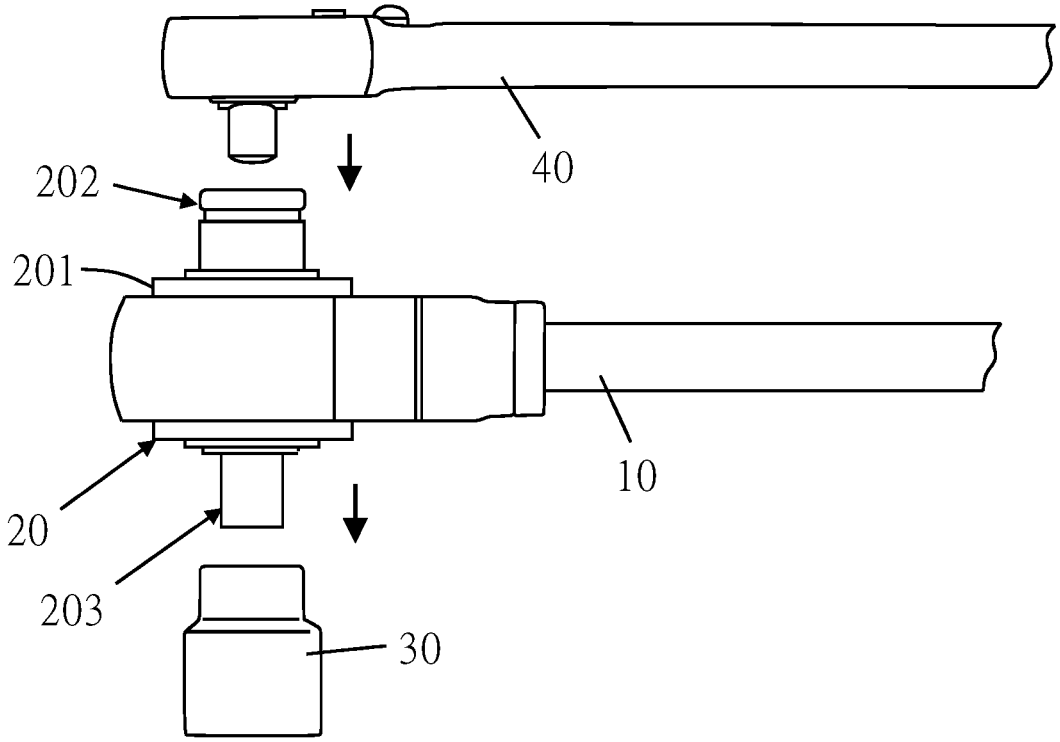
(PRIOR ART) FIG.2A
FIG. 2A (PRIOR ART) is the first schematic view of a hand-driven torque multiplier.
Figure 2B:
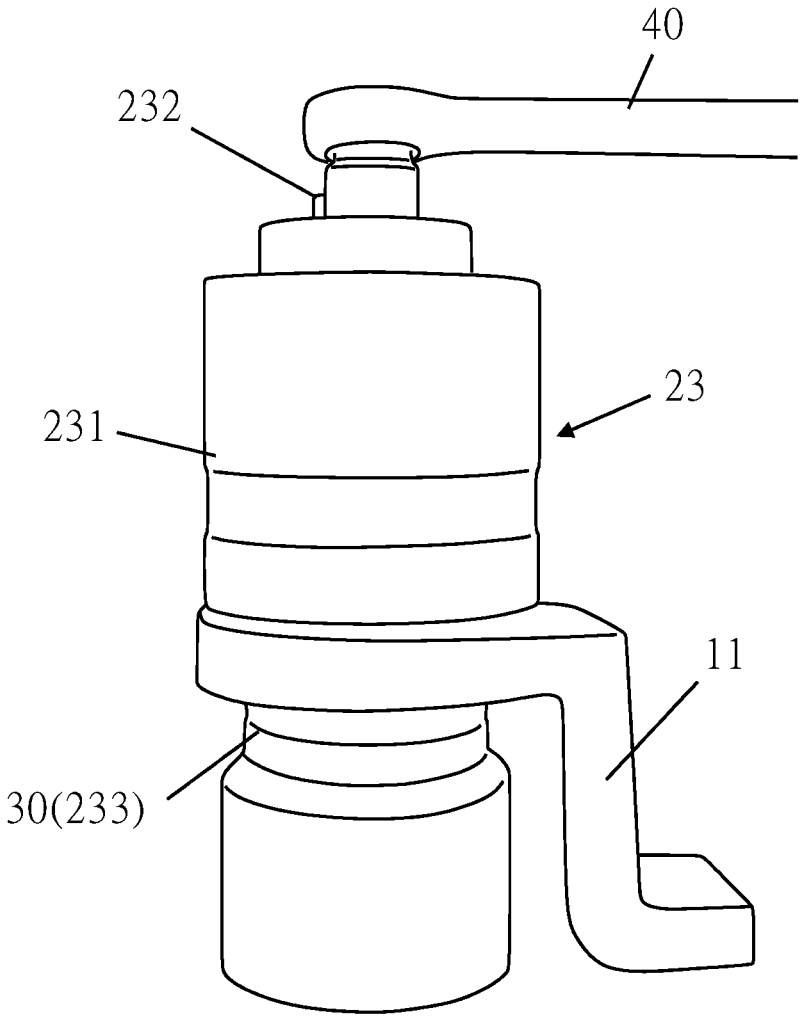
(PRIOR ART) FIG.2B
FIG. 2B (PRIOR ART) is the second schematic view of the hand-driven torque multiplier.
Figure 3:
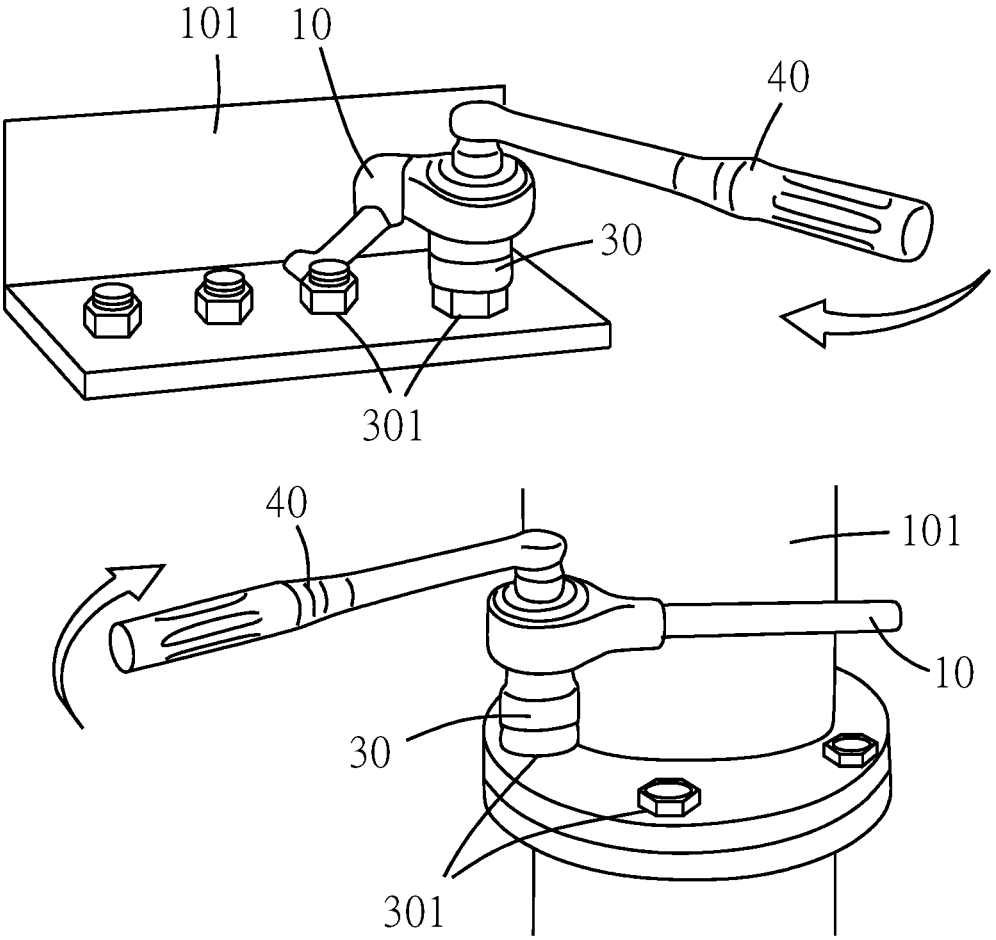
(PRIOR ART) FIG.3
FIG. 3 (PRIOR ART) is a schematic view of application of the hand-driven torque multiplier.
Figure 4A:
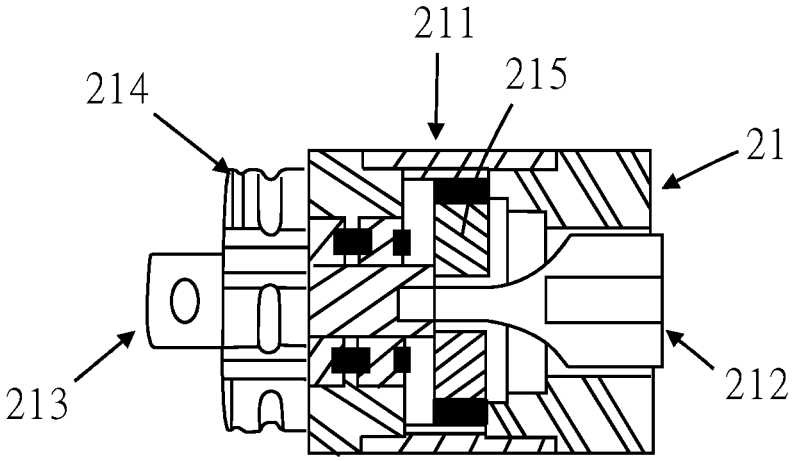
(PRIOR ART) FIG.4A
FIG. 4A (PRIOR ART) is a schematic view of a reduction gearing device of a torque multiplier.
Figure 4A:
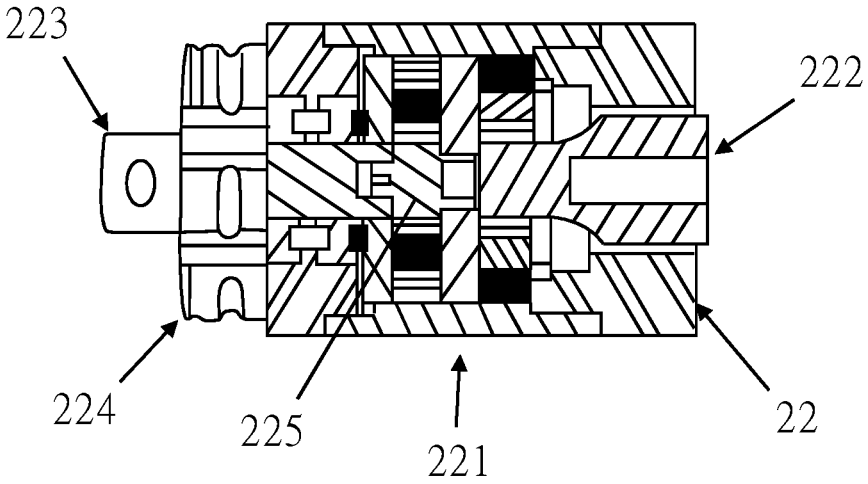
(PRIOR ART) FIG.4A
Figure 4B:
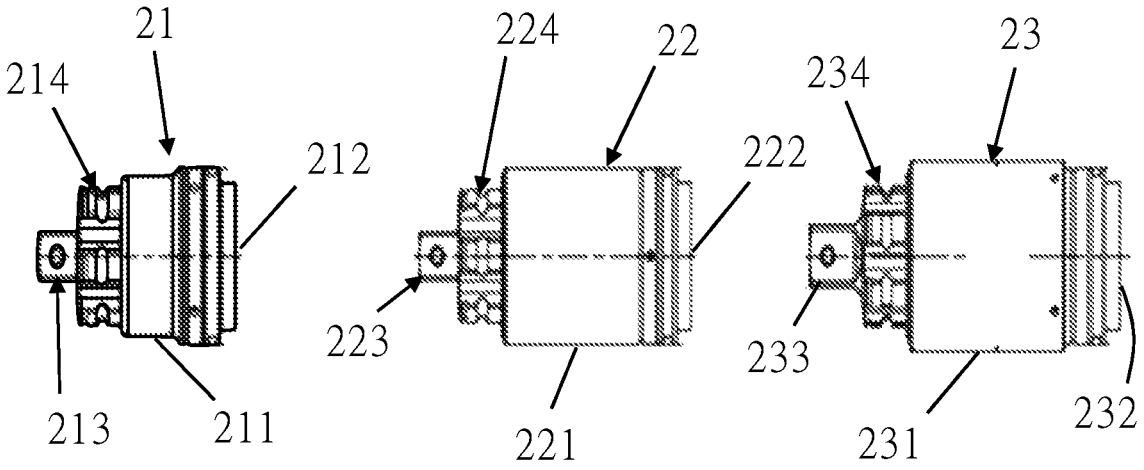
(PRIOR ART) FIG.4B
FIG. 4B (PRIOR ART) is a schematic view of the torque multiplier.
Figure 5A:
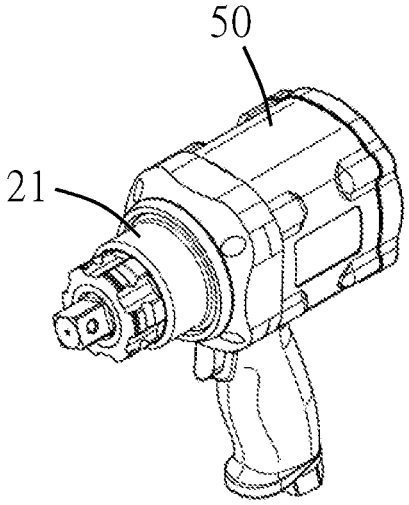
(PRIOR ART) FIG.5A
FIG. 5A (PRIOR ART) is the first schematic view of a pneumatically-driven torque multiplier for use in torque expansion.
Figure 5B:
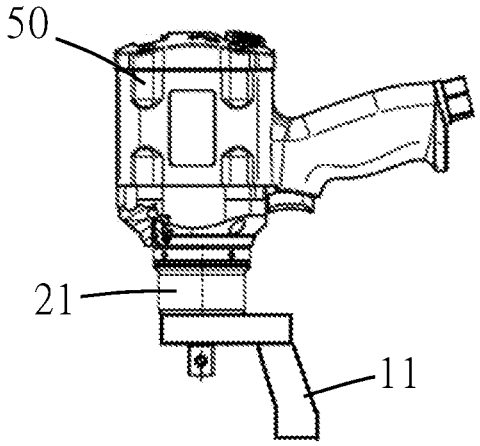
(PRIOR ART) FIG.5B
FIG. 5B (PRIOR ART) is the second schematic view of the pneumatically-driven torque multiplier for use in torque expansion.
Figure 5C:
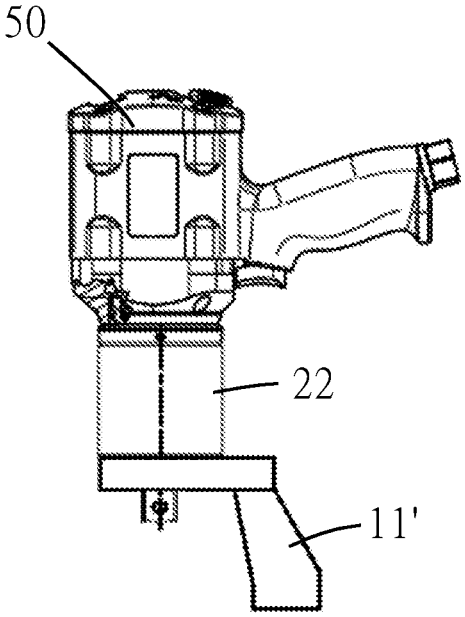
(PRIOR ART) FIG.5C
FIG. 5C (PRIOR ART) is the third schematic view of the pneumatically-driven torque multiplier for use in torque expansion.
Figure 5D:
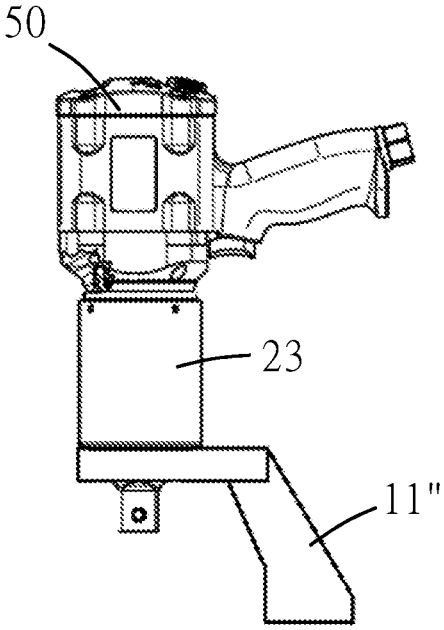
(PRIOR ART) FIG.5D
FIG. 5D (PRIOR ART) is the fourth schematic view of the pneumatically-driven torque multiplier for use in torque expansion.
Figure 6A:
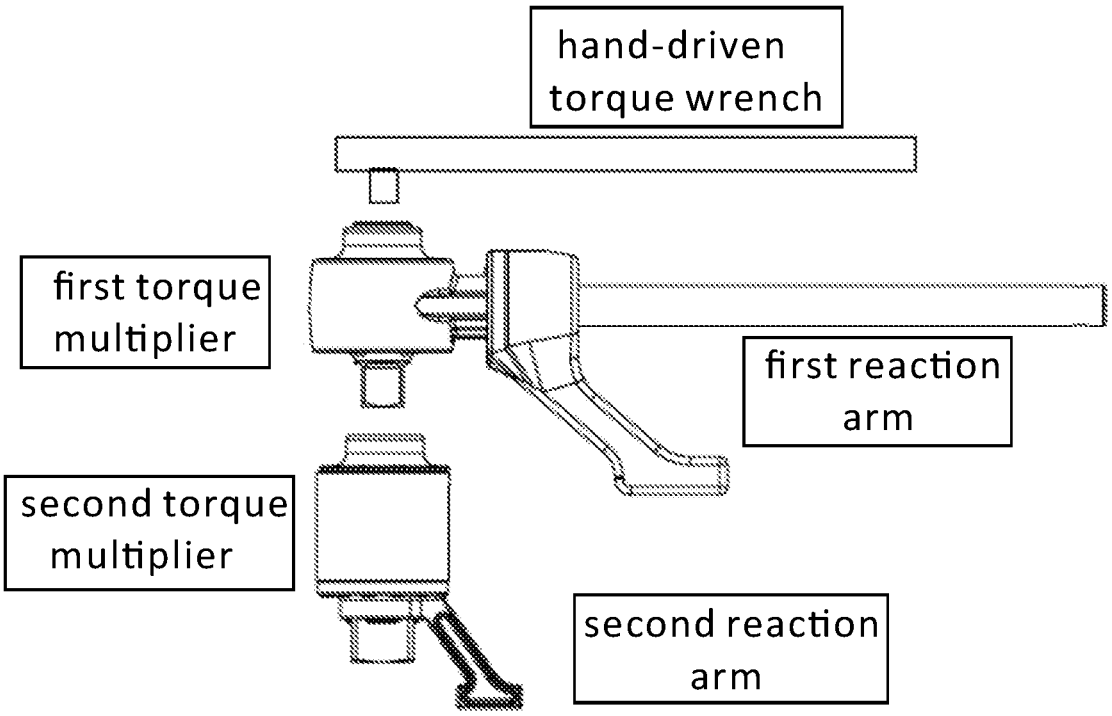
(PRIOR ART) FIG.6A
FIG. 6A (PRIOR ART) is a schematic view of a device whereby the hand-driven torque multiplier expands torque.
Figure 6B:
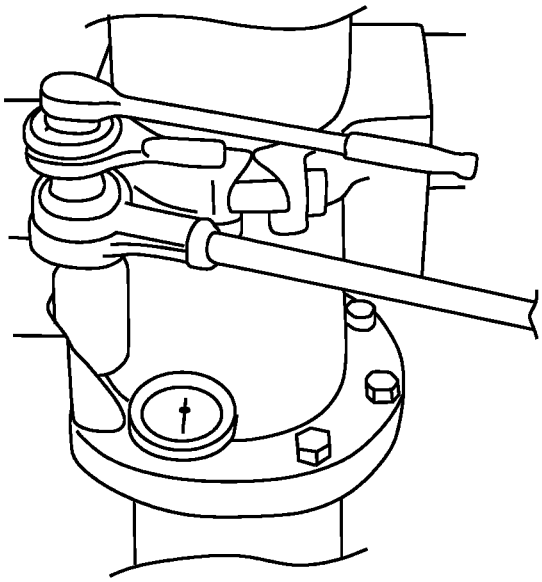
(PRIOR ART) FIG.6B
FIG. 6B (PRIOR ART) is a schematic view of application of the hand-driven torque multiplier.
Figure 7:
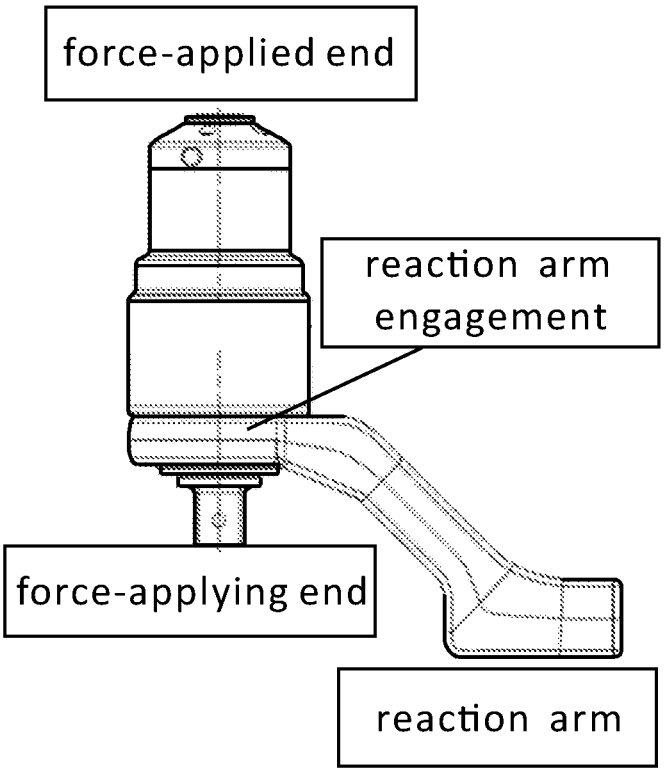
(PRIOR ART) FIG.7
FIG. 7 (PRIOR ART) is another schematic view of the device whereby the hand-driven torque multiplier expands torque.
Figure 8A:
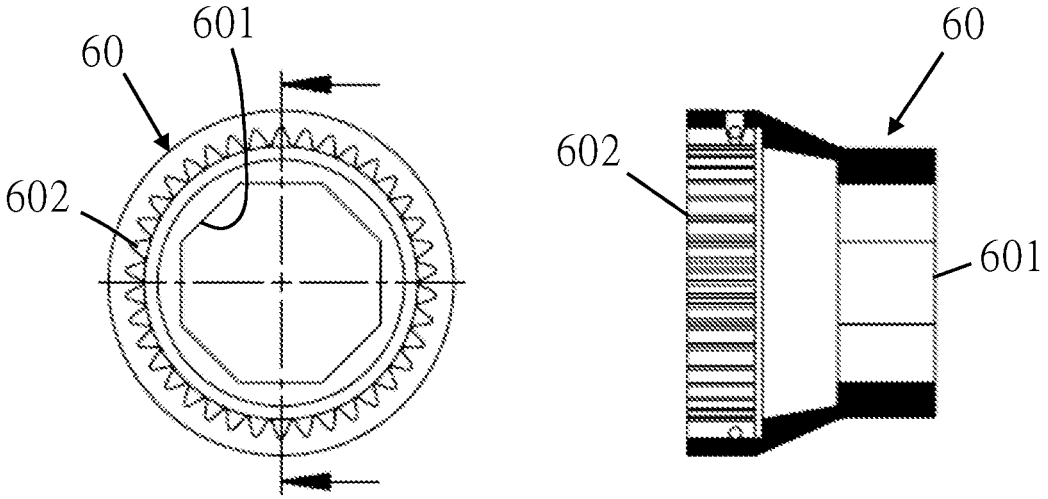
FIG. 8A is the first schematic view of a connection sleeve of the present disclosure.
Figure 8B:
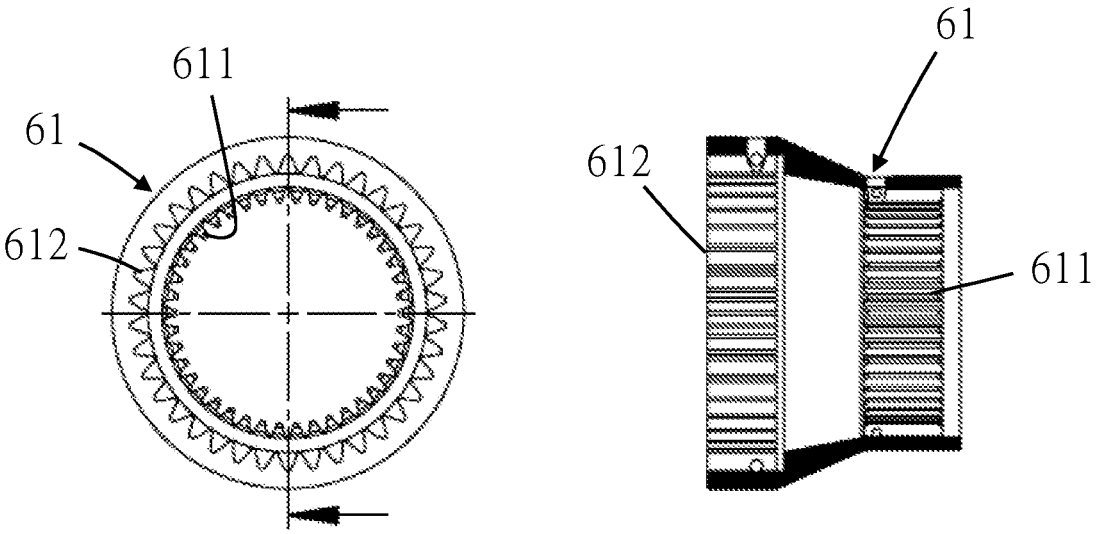
FIG. 8B is the second schematic view of the connection sleeve of the present disclosure.

Referring to FIG. 8A and FIG. 8B, the diagrams show connection sleeves 60, 61 of the present disclosure. As shown in FIG. 8A, force-applied end fastening mechanism 601 of connection sleeve 60 is polygonal. As shown in FIG. 8B, force-applied end fastening mechanism 611 of connection sleeve 61 is dentate. As shown in FIG. 8A and FIG. 8B, force-applying end fastening mechanisms 602, 612 of connection sleeves 60, 61 are dentate. Furthermore, connection sleeves 60, 61 are made in accordance the type and dimensions of the force-applying end fastening mechanism or force-applied end fastening mechanism of the customized torque multiplier fitted in place to attain rigid contact and become non-rotatable relative to each other.

Figure 9A:
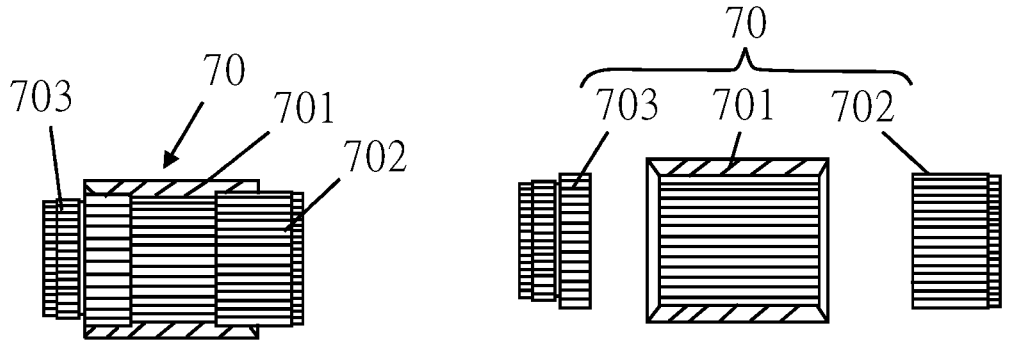
FIG. 9A is the first schematic view of a casing of the customized torque multiplier and a fastening mechanism of the present disclosure.
Figure 9B:
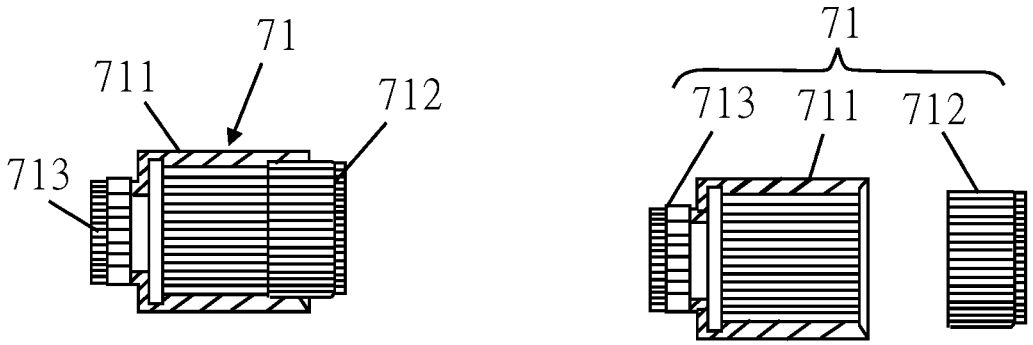
FIG. 9B is the second schematic view of the casing of the customized torque multiplier and the fastening mechanism of the present disclosure.
Figure 9C:
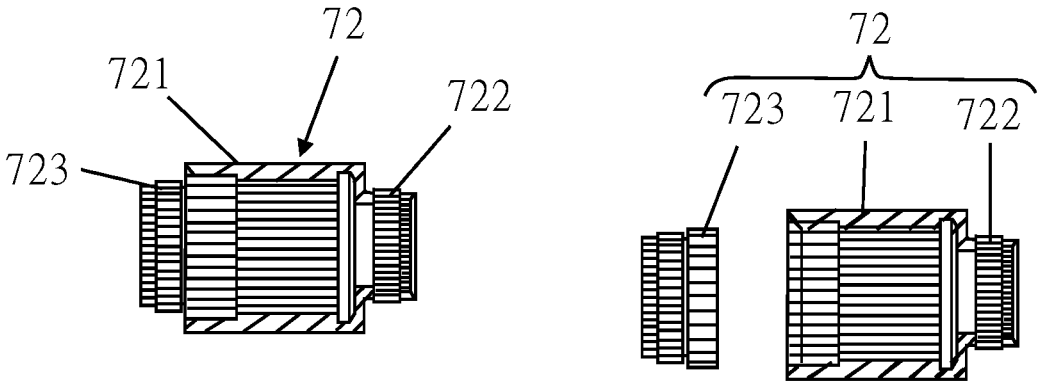
FIG. 9C is the third schematic view of the casing of the customized torque multiplier and the fastening mechanism of the present disclosure.

Referring to FIG. 9A through FIG. 9C, the diagrams show casings 701, 711, 721 of customized torque multipliers 70, 71, 72 and force-applied end fastening mechanisms 702, 712, 722 and force-applying end fastening mechanisms 703, 713, 723 of customized torque multipliers 70, 71, 72 of different types. Referring to FIG. 9A, force-applied end fastening mechanism 702 and force-applying end fastening mechanism 703 of customized torque multiplier 70 are joined to and fitted to two edges of casing 701, respectively.

The force-applied end fastening mechanism 702 and force-applying end fastening mechanism 703 correspond in dimensions and type of the fastening mechanisms at two joining ends of the two edges of the casing 701, respectively. A reduction gearing mechanism (not shown) is mounted in place inside casing 701 and disposed between force-applied end fastening mechanism 702 and force-applying end fastening mechanism 703. Referring to FIG. 9B, the force-applying end fastening mechanism 713 of customized torque multiplier 71 and the casing 711 are integrally formed; after the reduction gearing mechanism (not shown) has been mounted in place inside the casing 711, the force-applied end fastening mechanism 712 is fitted to the casing 711. Referring to FIG. 9C, the force-applied end fastening mechanism 722 of the customized torque multiplier 72 and the casing 721 are integrally formed; after the reduction gearing mechanism (not shown) has been mounted in place inside the casing 721, the force-applying end fastening mechanism 723 is fitted to the casing 721.

Figure 10:
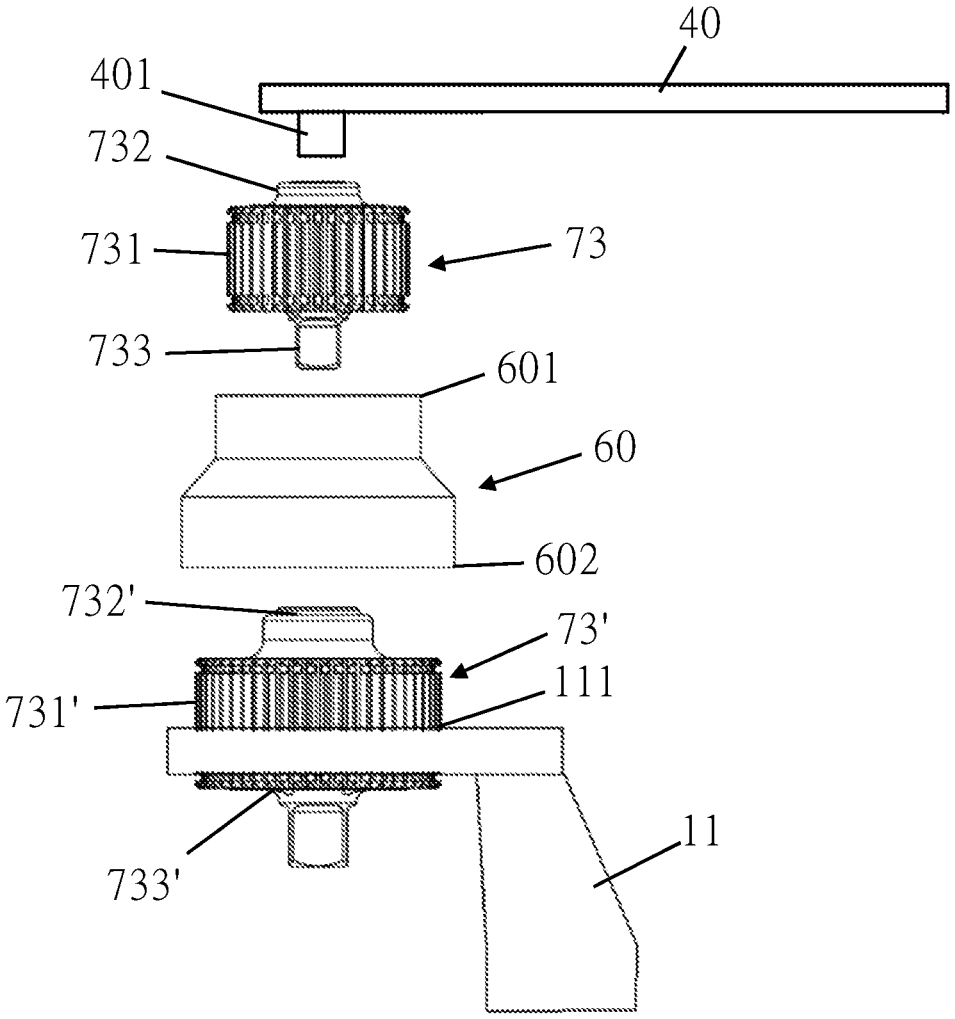
FIG. 10 is a schematic view of the device of the present disclosure in torque expansion in the presence of the hand-driven torque multiplier according to the present disclosure.

Referring to FIG. 10, the diagram shows the device of the present disclosure applicable to a hand-driven torque multiplier in torque expansion. During its operation, the device of the present disclosure uses one of the customized torque multipliers 70, 71, 72 shown in FIG. 9A through FIG. 9C to fit to one of the connection sleeves 60, 61 shown in FIG. 8A and FIG. 8B. As shown in FIG. 10, the force-applying anvil of force-applying end fastening mechanism 401 of hand-driven torque wrench 40 is fitted to the force-applied bushing of force-applied end fastening mechanism 732 of customized torque multiplier 73; the force-applying anvil of force-applying end fastening mechanism 401 of hand-driven torque wrench 40 corresponds in dimensions and type to the force-applied bushing of force-applied end fastening mechanism 732 of customized torque multiplier 73, allowing force-applying end fastening mechanism 733 of customized torque multiplier 73 to fit to force-applied end fastening mechanism 601 of connection sleeve 60, allowing force-applying end fastening mechanism 733 of customized torque multiplier 73 to correspond in dimensions and type to force-applied end fastening mechanism 601 of connection sleeve 60. Then, force-applying end 602 of connection sleeve 60 is fitted to one of the customized torque multipliers 70, 71, 72 shown in FIG. 9A through FIG. 9C. The force-applying end fastening mechanism 602 of connection sleeve 60 corresponds in dimensions and type to the force-applied end fastening mechanism 731' of customized torque multiplier 73'. After that, force-applying end fastening mechanism 733' of customized torque multiplier 73' is fitted to the reaction arm 11 in order to start the bolting process. The force-applying end fastening mechanism 733' of customized torque multiplier 73' corresponds in dimensions and type to the force-applied end fastening mechanism 111 of reaction arm 11. Furthermore, in this embodiment, force-applied end fastening mechanisms 732, 732' and force-applying end fastening mechanisms 733, 733' are directly formed at the outer edges of casings 731, 731' of two customized torque multipliers 73, 73'.

Figure 11A:
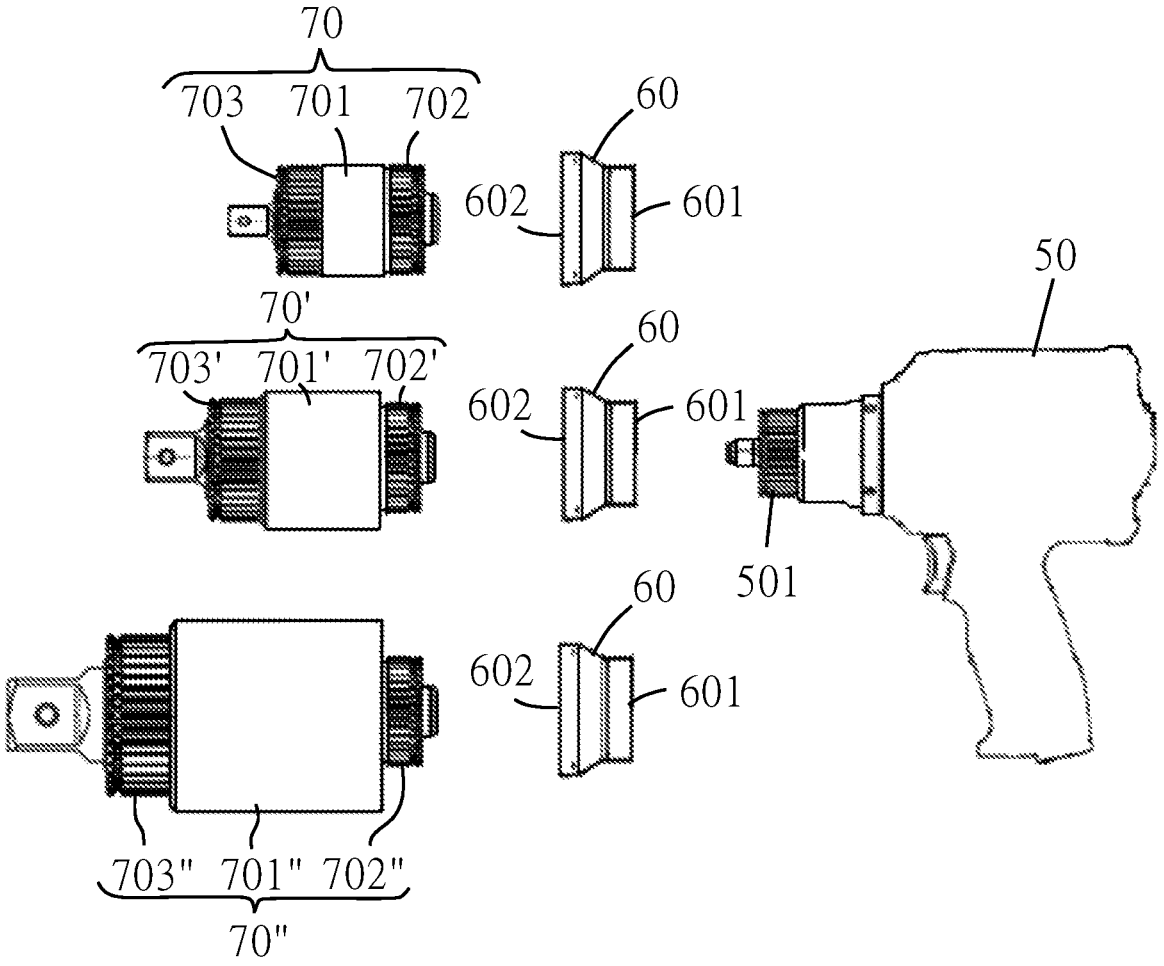
FIG. 11A is an exploded view of the device of the present disclosure in torque expansion in the presence of a pneumatically-driven torque multiplier according to the present disclosure.

Referring to FIG. 11A, the diagram shows the device of the present disclosure applicable to a pneumatically-driven torque multiplier (or electrically-driven torque multiplier) in torque expansion. The force-applying end fastening mechanism 501 of the low-torque, high-rotation-speed pneumatically-driven torque wrench 50 is fitted to the force-applied end fastening mechanism 601 of the connection sleeve 60. The connection sleeve 60 is one of the connection sleeves 60, 61 shown in FIG. 8A and FIG. 8B. The force-applying end fastening mechanism 501 of the pneumatically-driven torque wrench 50 corresponds in dimensions and type to the force-applied end fastening mechanism 601 of the connection sleeve 60. Then, the force-applying end fastening mechanism 602 of the connection sleeve 60 is fittedly connected to force-applied end fastening mechanisms 702, 702', 702" of customized torque multipliers 70, 70', 70". In this embodiment, force-applied end fastening mechanisms 702, 702', 702" are of the same dimensions and type and match force-applying end fastening mechanism 602 of connection sleeve 60, such that connection sleeve 60 of the same dimensions and type can be fittedly connected to the same force-applied end fastening mechanisms 702, 702', 702". The customized torque multipliers 70, 71, 72 are of different specifications. The customized torque multipliers 70, 70', 70" are each a corresponding one of the customized torque multipliers 70, 71, 72 shown in FIG. 9A through FIG. 9C. The force-applying end fastening mechanism 602 of connection sleeve 60 corresponds in dimensions and type to force-applied end fastening mechanisms 702, 702', 702" of customized torque multipliers 70, 70', 70". The customized torque multipliers 70, 70', 70" are of multiple specifications, including different reduction ratios and torque magnification ratios. The force-applying end fastening mechanisms 703, 703', 703" of customized torque multipliers 70, 70', 70" match the reaction arms of different dimensions and types, respectively.

Figure 11B:
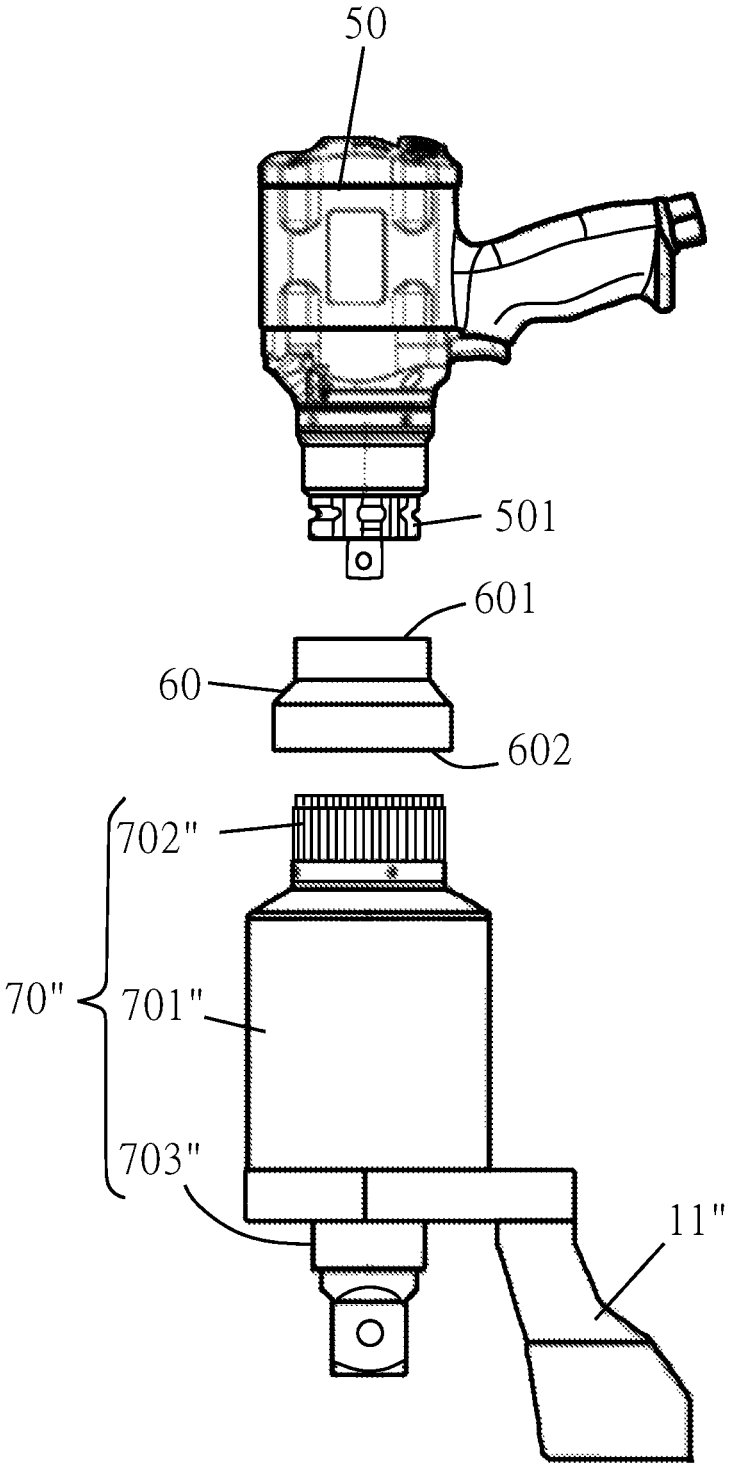
FIG. 11B is a schematic view of the device of the present disclosure in torque expansion in the presence of the pneumatically-driven torque multiplier according to the present disclosure.

Referring to FIG. 11B, pneumatically-driven torque wrench 50, connection sleeve 60 and customized torque multiplier 70" are fittedly connected to reaction arm 11".

According to the present disclosure, the torque wrenches 40, 50, connection sleeves 60, 61 and customized torque multipliers 70, 70', 70", 71, 72, 73, 73' are fitted together to form an integral structure. Furthermore, connection sleeves 60, 61 are made of metal or non-metal, whereas the connection sleeves 60, 61 have sufficient structural strength to sustain torque wrenches 40, 50 and customized torque multipliers 70, 70', 70", 71, 72, 73, 73'. The present disclosure further provides a torque capacity expandable method for a torque multiplier. The method involves fittedly connecting the force-applied end fastening mechanisms 601, 611 and force-applying end fastening mechanisms 602, 612 of connection sleeves 60, 61 to torque wrenches 40, 50 and customized torque multipliers 70, 70', 70", 71, 72, 73, 73' for expanding torque capacity, respectively. The customized torque multipliers 70, 70', 70", 71, 72, 73, 73' have multiple torque magnification ratios.

Figure 12A:
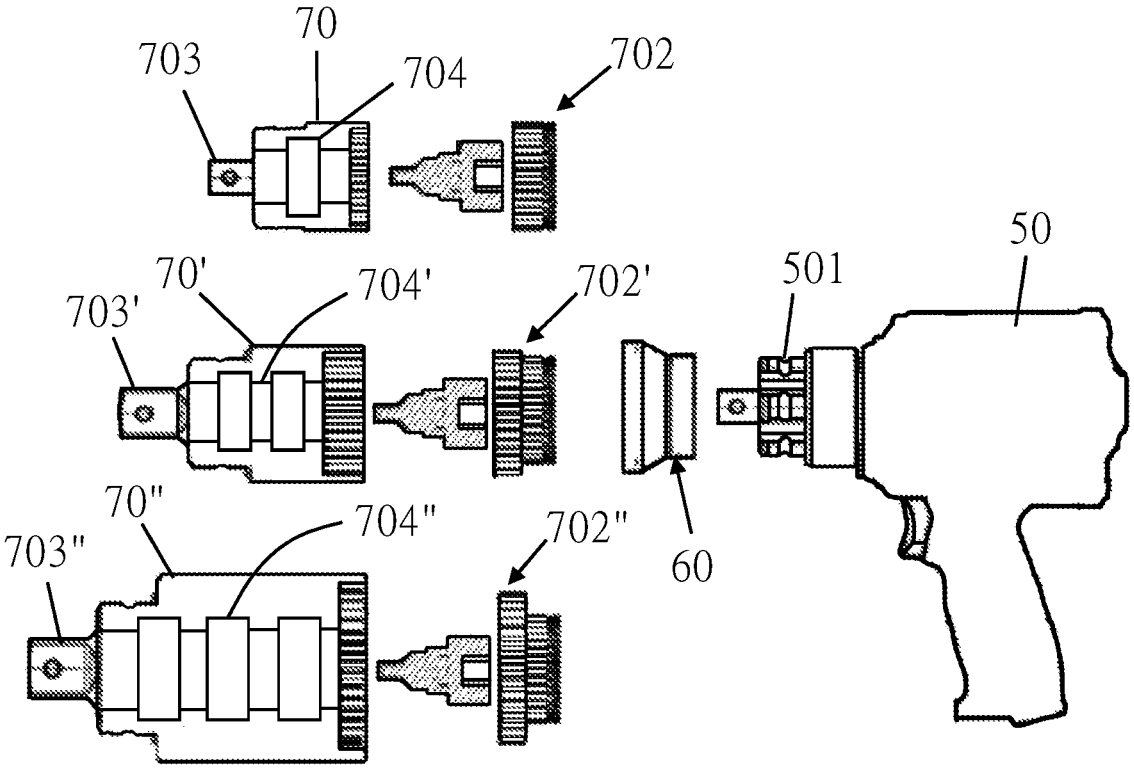
FIG. 12A is the first schematic view of the device of the present disclosure in torque expansion in the presence of the pneumatically-driven torque multiplier according to the present disclosure.
Figure 12B:
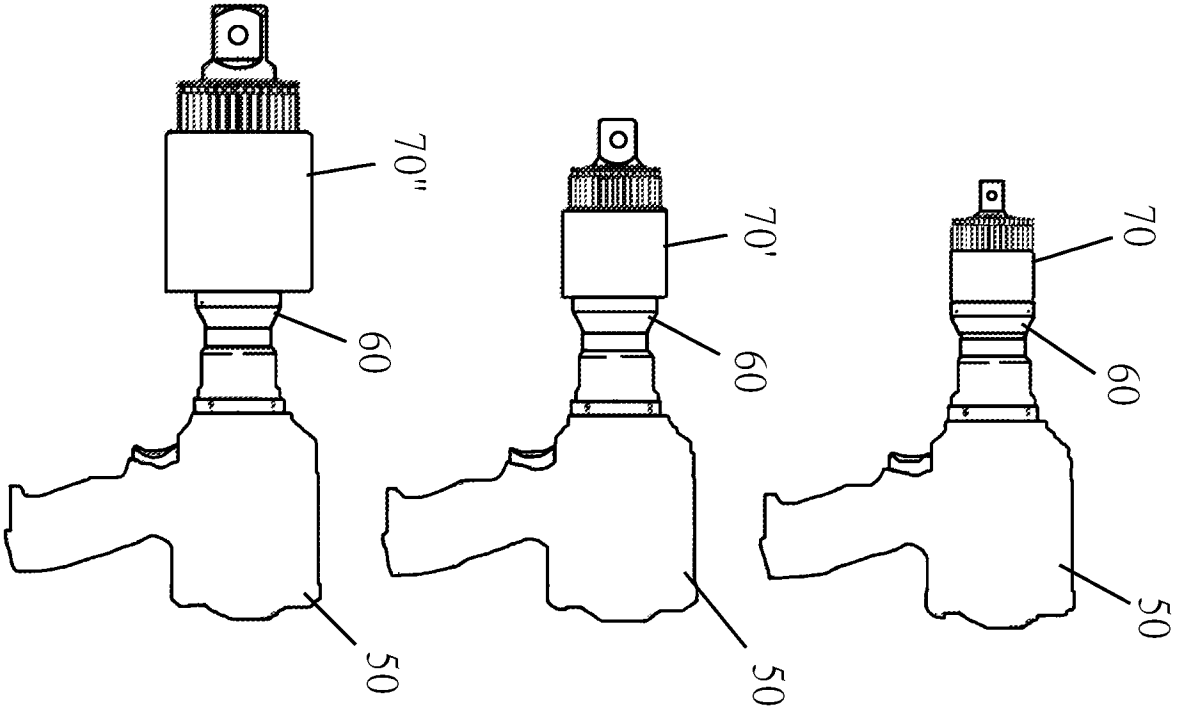
FIG. 12B is second schematic view of the device of the present disclosure in torque expansion in the presence of the pneumatically-driven torque multiplier according to the present disclosure.
Figure 12C:
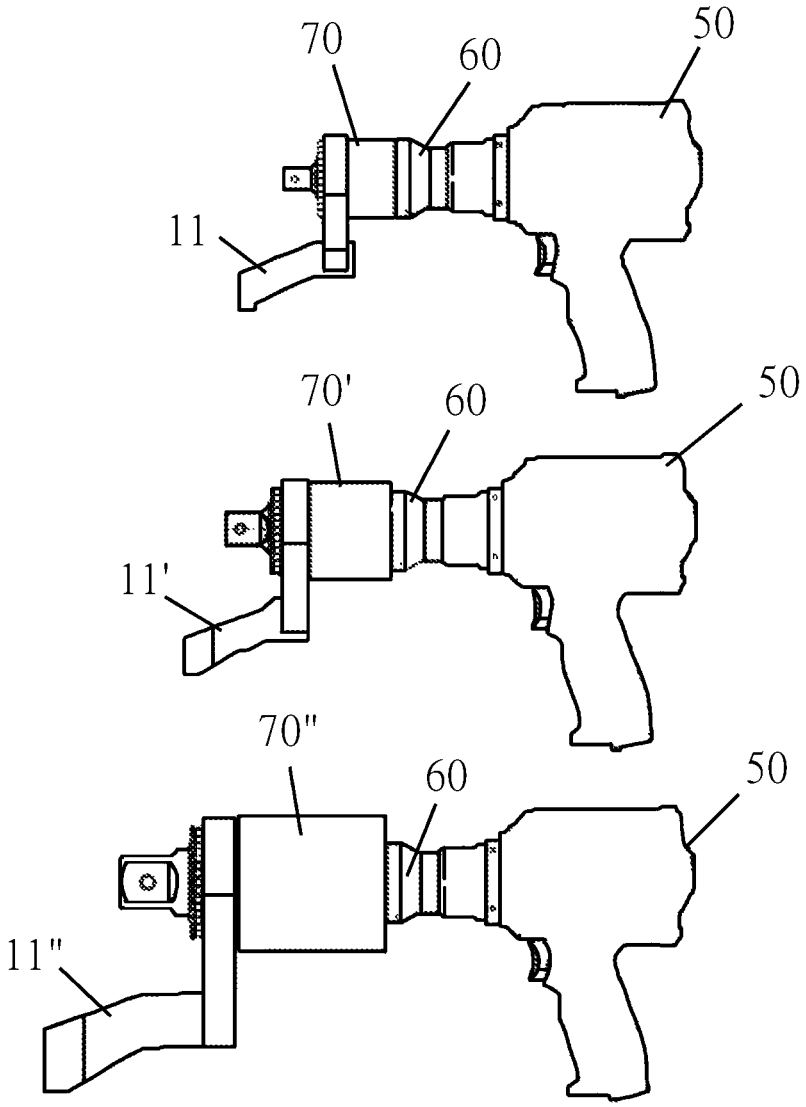
FIG. 12C is the third schematic view of the device of the present disclosure in torque expansion in the presence of the pneumatically-driven torque multiplier according to the present disclosure.

Referring to FIG. 12A, there is shown an exploded view, showing connection sleeve 60, customized torque multipliers 70, 70', 70" and pneumatically-driven torque wrench 50 (or electrically-driven torque wrench). The connection sleeve 60 is one of the connection sleeves 60, 61 shown in FIG. 8A and FIG. 8B. The customized torque multipliers 70, 70', 70" are each one of the customized torque multipliers 70, 71, 72 shown in FIG. 9A through FIG. 9C. The customized torque multiplier 70 has a single-stage reduction gearing mechanism 704 whereby the input torque can be expanded. The customized torque multiplier 70' has a multi-stage reduction gearing mechanism 704' whereby the input torque can be expanded. The customized torque multiplier 70" has a multi-stage reduction gearing mechanism 704" whereby the input torque can be expanded. FIG. 12B shows how connection sleeve 60, customized torque multipliers 70, 70', 70" and pneumatically-driven torque wrench 50 (or electrically-driven torque wrench) of FIG. 12A are fitted together. FIG. 12C shows how connection sleeve 60, customized torque multipliers 70, 70', 70" and pneumatically-driven torque wrench 50 (or electrically-driven torque wrench) and reaction arm 11 are fitted together. The connection sleeve 60 of FIG. 12A through FIG. 12C and FIG. 11A and FIG. 11B is of the same specifications, dimensions and type to thereby reduce production and inventory cost. However, the dimensions or fastening structure of connection sleeve 60 of FIG. 12A through FIG. 12C and FIG. 11A and FIG. 11B is subject to changes as needed.

Figure 13:
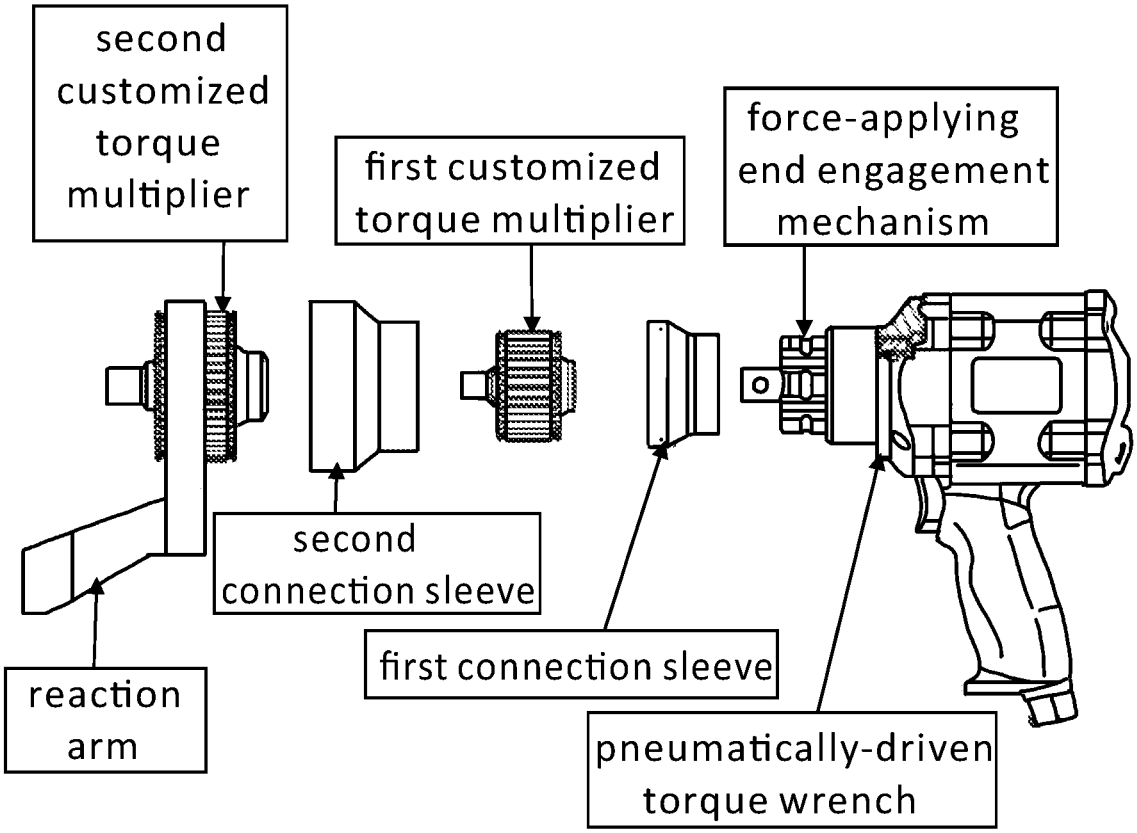
FIG. 13 is an exploded view of the device of the present disclosure in torque expansion in the presence of the pneumatically-driven torque multiplier according to the present disclosure.

Referring to FIG. 13, the pneumatically-driven torque multiplier (or electrically-driven torque multiplier) is applicable to at least one connection sleeve and at least one customized torque multiplier. Therefore, the pneumatically-driven torque multiplier (or electrically-driven torque multiplier) (which has one connection sleeve and one customized torque multiplier) can perform a multiple high-torque bolting process in a cost-efficient manner.

Figure 14:
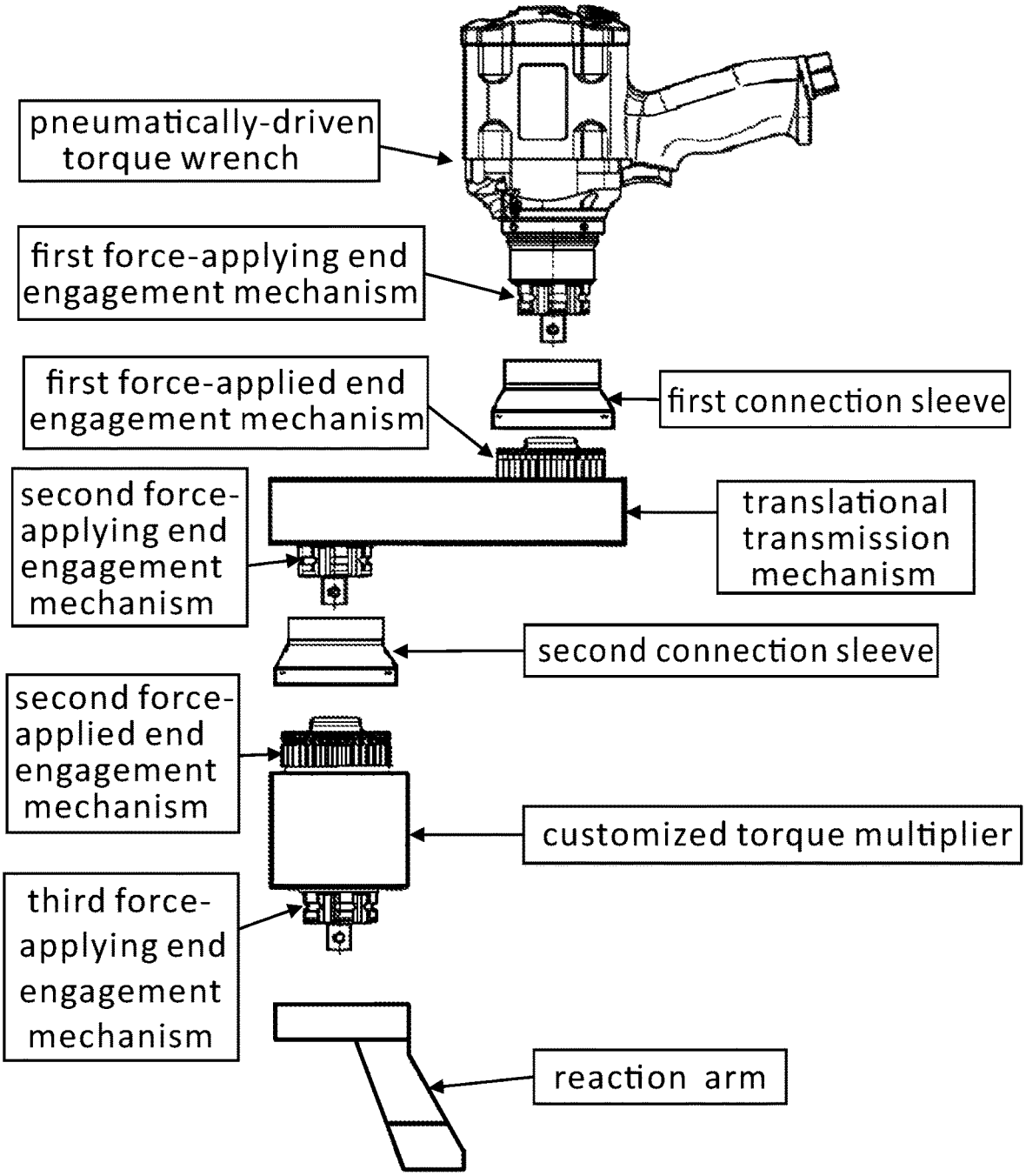
FIG. 14 is an exploded view of the device of the present disclosure in torque expansion in the presence of the pneumatically-driven torque multiplier according to the present disclosure.

Referring to FIG. 14, the pneumatically-driven torque multiplier (or electrically-driven torque multiplier) operating in conjunction with a translational transmission mechanism is applicable to at least one connection sleeve and at least one customized torque multiplier through a translational transmission mechanism. Therefore, the pneumatically-driven torque multiplier effectuates long-distance torque transmission and torque expansion through the translational transmission mechanism and thereby effectively performs a mounting operation at a special working position.

While the present disclosure has been described by means of specific embodiments, numerous modifications and variations could be made thereto by those skilled in the art without departing from the scope and spirit of the present disclosure set forth in the claims.

What is claimed is:

1. A torque capacity expandable device for a torque multiplier, the device comprising:

a connection sleeve having a force-applied end fastening mechanism and a force-applying end fastening mechanism, with the force-applied end fastening mechanism fittedly connected to a force-applying end fastening mechanism of a torque wrench, wherein the force-applying end fastening mechanism of the connection sleeve is fittedly connected to the force-applied end fastening mechanism of the customized torque multiplier; and a customized torque multiplier having a single-stage or multi-stage reduction gearing mechanism for expanding an input torque, the customized torque multiplier having a casing, a force-applied end fastening mechanism and a force-applying end fastening mechanism, wherein the force-applied end fastening mechanism of the customized torque multiplier is fittedly connected to the force-applying end fastening mechanism of the connection sleeve, thereby allowing the torque wrench, the connection sleeve and the customized torque multiplier to be fitted to each other to form an integral structure;

wherein the casing of the customized torque multiplier and the force-applied end fastening mechanism of the customized torque multiplier are fittedly formed, whereas the casing of the customized torque multiplier and the force-applying end fastening mechanism of the customized torque multiplier are fittedly formed.

2. The device of claim 1, wherein the connection sleeve is made of metal, and the connection sleeve has sufficient structural strength to sustain the torque wrench and the customized torque multiplier.

3. The device of claim 1, wherein the connection sleeve is made of non-metal, and the connection sleeve has sufficient structural strength to sustain the torque wrench and the customized torque multiplier.

4. The device of claim 1, wherein the force-applied end fastening mechanism of the connection sleeve corresponds in dimensions and type to the force-applying end fastening mechanism of the torque wrench, and the force-applying end fastening mechanism of the connection sleeve corresponds in dimensions and type to the force-applied end fastening mechanism of the customized torque multiplier, thereby being fixed in place with fastening elements after being fittedly connected.

5. The device of claim 1, wherein the force-applied end fastening mechanism of the customized torque multiplier corresponds in dimensions and type to the force-applying end fastening mechanism of the connection sleeve, and the force-applying end fastening mechanism of the customized torque multiplier corresponds in dimensions and type to the force-applied end fastening mechanism of a reaction arm or the force-applied end fastening mechanism of another connection sleeve.

6. A torque capacity expandable device for a torque multiplier, the device comprising: a connection sleeve having a force-applied end fastening mechanism and a force-applying end fastening mechanism, with the force-applied end fastening mechanism fittedly connected to a force-applying end fastening mechanism of a torque wrench, wherein the force-applying end fastening mechanism of the connection sleeve is fittedly connected to the force-applied end fastening mechanism of the customized torque multiplier and a customized torque multiplier having a single-stage or multi-stage reduction gearing mechanism for expanding an input torque, the customized torque multiplier having a casing, a force-applied end fastening mechanism and a force-applying end fastening mechanism, wherein the force-applied end fastening mechanism of the customized torque multiplier is fittedly connected to the force-applying end fastening mechanism of the connection sleeve, thereby allowing the torque wrench, the connection sleeve and the customized torque multiplier to be fitted to each other to form an integral structure; wherein the casing of the customized torque multiplier and the force-applied end fastening mechanism of the customized torque multiplier are integrally formed, or the casing of the customized torque multiplier and the force-applying end fastening mechanism of the customized torque multiplier are integrally formed.

7. The device of claim 1, wherein a force-applied bushing of the customized torque multiplier corresponds in dimensions and type to a force-applying anvil sustaining the torque wrench.

* * * * *